US005447491A

United States Patent [19]

Bellandi

[11] Patent Number: 5,447,491

[45] Date of Patent: Sep. 5, 1995

[54] MASSAGING DEVICE

[76] Inventor: Giuseppe Bellandi, Via Gramsci 6, Roncadelle (Brescia), Italy

[21] Appl. No.: 54,747

[22] Filed: Apr. 27, 1993

[30] Foreign Application Priority Data

Apr. 28, 1992 [IT] Italy ..... BS92U0049

[51] Int. Cl.[6] ..... A61H 7/00

[52] U.S. Cl. ..... 601/112; 601/108; 601/89; 601/134

[58] Field of Search ..... 601/133–137, 601/85, 87, 88, 89, 93, 94, 95, 96, 97, 101, 103, 107–114

[56] References Cited

U.S. PATENT DOCUMENTS

| | | | |
|---|---|---|---|
| 1,579,679 | 10/1924 | Wahrt | 128/54 |
| 1,635,917 | 9/1925 | Wright | 128/55 |
| 2,519,790 | 8/1950 | Quinn | 601/113 |
| 3,968,789 | 7/1976 | Simoncini | 601/112 |
| 4,777,945 | 10/1988 | Curtaz | 601/110 |
| 4,856,496 | 8/1989 | Chursinoff | 128/25 B |
| 5,105,802 | 4/1992 | Pokorny | 128/56 |
| 5,159,922 | 11/1992 | Mabuchi | 128/52 |

FOREIGN PATENT DOCUMENTS

| | | | |
|---|---|---|---|
| 44107 | 1/1982 | European Pat. Off. | 601/112 |
| 4297259 | 10/1992 | Japan | 601/108 |
| 365832 | 1/1962 | Switzerland | 128/52 |

*Primary Examiner*—Robert A. Hafer
*Assistant Examiner*—David J. Kenealy
*Attorney, Agent, or Firm*—McGlew and Tuttle

[57] ABSTRACT

An anticellulitis massaging device comprising a plurality of massaging elements or fingers (11) located within a body member or casing (10) and susceptible of axial percussion movements and oscillating and/or rotating movements, which are controlled by a motor assembly (12,12*a*) and via cam actuating means (15*a*,25*a*).

5 Claims, 1 Drawing Sheet

MASSAGING DEVICE

FIELD OF THE INVENTION

SUMMARY AND OBJECTS OF THE INVENTION

The present invention relates to an anticellulitis massaging device operated by an electric motor.

The main object of this invention is to provide a massaging device comprising a plurality of elements or fingers provided with percussion and/or oscillating and/or rotatory movements however combined, to produce an effective massaging action on the body, particularly suited for favouring dissolution of cellulitis.

In a first embodiment of the anticellulitis massaging device according to the invention, the massaging elements or fingers have movement conversion means causing them to be susceptible to axial movement and oscillatory movement, whereas in a second embodiment the massaging elements or fingers rotate along with a rotating support, besides oscillating and moving axially.

Further details will become apparent from the continuation of the description of the invention, illustrated only by way of non-limitative example with reference to the accompanying drawings, in which:

DETAILED DESCRIPTION OF THE PREFERRED EMBODIMENT

Figure 1:
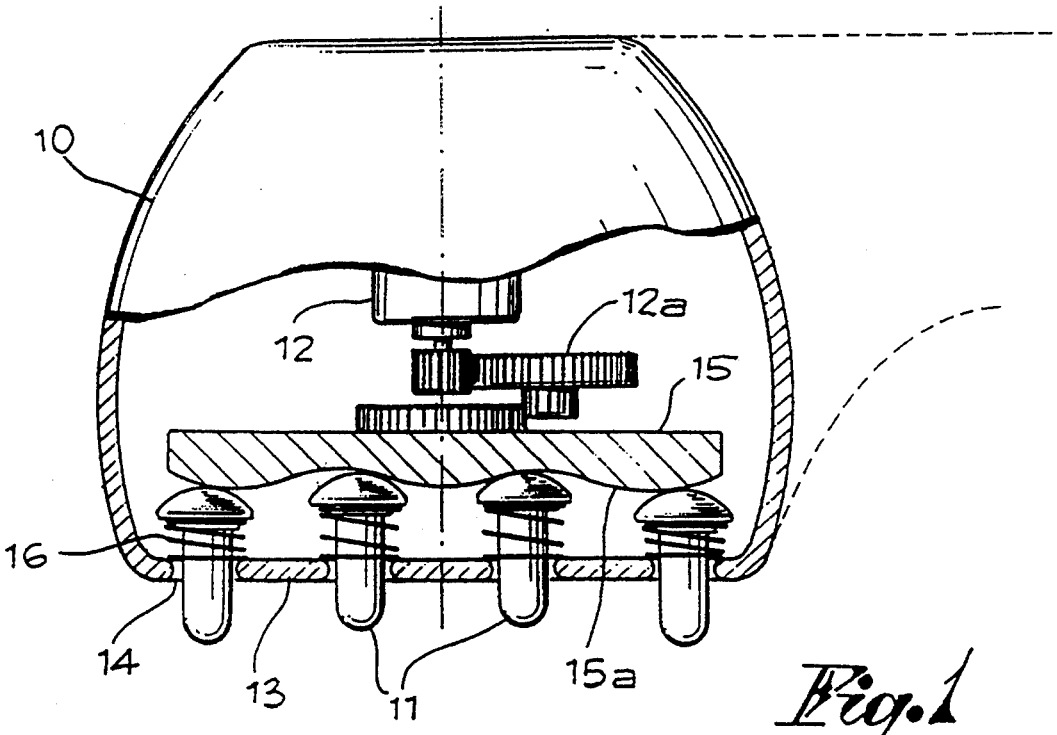
FIG. 1 shows a sectional view of a first embodiment of the massaging device.

The devices illustrated in the drawings essentially comprise a body member or casing 10, a plurality of massaging elements or fingers 11 and an electric motor 12 housed inside the body member, which operates the elements or fingers.

According to the embodiment illustrated in FIG. 1, the body member or casing 10, which may include a handle—not illustrated in the Figures—comprises a base plane 13 provided with a multiplicity of finger holes 14, each of which movably receives a massaging element 11 having both ends rounded.

More particularly, one end of each massaging element 11 is designed to protrude from the base 13 of the body 10, while the other end rests against the front surface 15*a* of a rotating disc or cam means 15. Each massaging element 11 is stressed by a recoil spring 16, which normally tends to move the element 11 to a recessed position inside the base 13 of the body 10 and to ensure constant contact thereof against the rotating disc 15.

The rotating disc 15 is driven by an electric motor 12 via a driving gearing 12*a*. Its front surface 15*a* in contact with the massaging elements or fingers 11 is cam-shaped, or wavy in various forms. The rotation of the control disc 15, which is caused by the motor assembly 12,12*a*, is therefore associated with axial to-and-fro movements of the massaging elements, owing to a combined action of the cam-shaped surface 15*a* and the recoil springs 16. On the other hand, by an adequate configuration of the cam-shaped surface 15*a* of the disc 15, oscillating movements may also be imparted to the massaging elements 11 in order to enhance effectiveness of the device.

Figure 2:
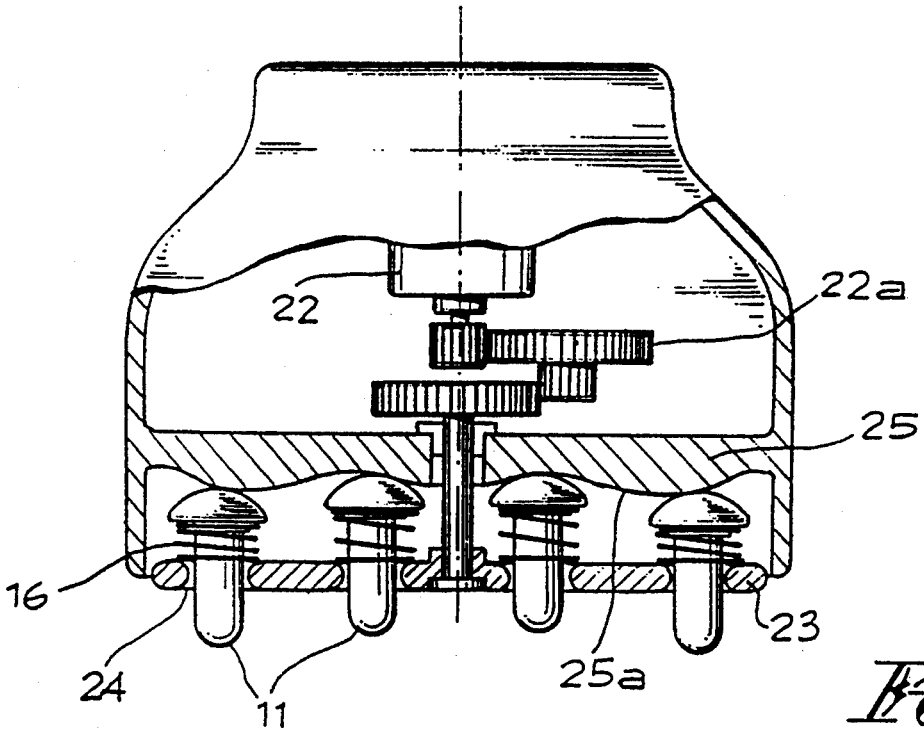
FIG. 2 shows a similar sectional view of a second embodiment of the massaging device according to the invention.

The embodiment illustrated in FIG. 2 comprises massaging elements or fingers 11 mounted as described with reference to FIG. 1, though in holes 24 provided a base 23 comprising a rotating disc rotated by an electric motor 22 via a driving gearing 22*a*. According to this embodiment, the massaging elements 11 are stressed by their respective recoil springs 16 against a fixed cam-shaped surface 25*a*, which is defined by a wall 25 integrally formed with a body member or casing. This configuration permits the massaging elements or fingers 11 to rotate along with the base disc, besides being susceptible of axial and oscillatory movement as described with reference to FIG. 1, thus developing more intense massaging action when the device is used. In fact, the combined movements of the elements or fingers, exerted on a body subjected to massage, provide continual compression, friction and relaxing action on tissues, and are particularly suitable for to dissolving cellulitis, as well as for skin and muscles.

While specific embodiments of the invention have been shown and described in detail to illustrate the application of the principles of the invention, it will be understood that the invention may be embodied otherwise without departing from such principles.

I claim:

1. A massaging device comprising:

a body;

a plurality of massaging elements, each of said plurality of massaging elements being movably positioned in said body;

a motor positioned inside said body;

movement conversion means connected to said motor and said plurality of massaging elements, and for converting movement of said motor into movement of said massaging elements in an axial direction of said plurality of massaging elements, and to simultaneously rotate said plurality of massaging elements about an axis substantially parallel to said axial direction of said plurality of elements, said movement conversion means includes a wall fixed to said body, said wall having a cam-shaped surface, said movement conversion means also including a base plate mounted at one end of said body and means for transmitting rotational motion to said base plate from said motor, said base plate defining a plurality of finger holes, each of said plurality of massaging elements being movably positioned in a separate one of said plurality of finger holes, said each of said plurality of massaging elements having a first end extending out of said body and a second end substantially opposite said first end, said each of said plurality of massaging elements including a recoil spring means for biasing said second end in contact with said cam-shaped surface of said wall.

2. An anticellulitis massaging device comprising:

a body;

a motor positioned inside said body;

a base plate rotatably mounted at one end of said body and having means for being rotated by said motor, said base plate defining a plurality of finger holes;

a plurality of massaging elements, each of said plurality of massaging elements being movably positioned in a separate one of said plurality of finger holes, said each of said plurality of massaging elements having a first end extending out of said body and a second end substantially opposite said first end;

cam means in contact with said plurality of massaging elements and for cooperating with said motor to simultaneously move said massaging elements in axial percussion movements, oscillating movements and rotatory movements, said cam means includes a wall fixed to said body, said wall having a cam-shaped surface, said each of said plurality of massaging elements including a recoil spring means for biasing said second end in contact with said cam-shaped surface of said wall.

3. A device in accordance with claim 2, wherein:

said rotary movements of said massaging elements are about an axis of rotation of said base plate.

4. A device in accordance with claim 1, wherein:

said movement conversion means simultaneously moves said massaging elements in axial percussion movements, oscillating movements and rotatory movements.

5. A device in accordance with claim 4, wherein:

said rotary movements of said massaging elements are about an axis of rotation of said base plate.

* * * * *